US006386073B1

(12) United States Patent
Chen

(10) Patent No.: US 6,386,073 B1
(45) Date of Patent: May 14, 2002

(54) OPEN ENDED WRENCH

(76) Inventor: Shwu Ruu Chen, 1, Alley 16, Lane 40, Jinn Te Road, Taichung (TW)

( * ) Notice: Subject to any disclaimer, the term of this patent is extended or adjusted under 35 U.S.C. 154(b) by 0 days.

(21) Appl. No.: 09/823,453

(22) Filed: Mar. 30, 2001

(51) Int. Cl.[7] ..... B25B 13/28
(52) U.S. Cl. ..... 81/99
(58) Field of Search ..... 81/99, 111, 186

(56) References Cited

U.S. PATENT DOCUMENTS 2,618,996 A * 11/1952 Logan ..... 81/99 X
3,309,949 A * 3/1967 Neff ..... 81/111
5,996,445 A * 12/1999 Wiens et al. ..... 81/99 X
6,167,784 B1 * 1/2001 Lin ..... 81/99

* cited by examiner

*Primary Examiner*—D. S. Meislin
(74) *Attorney, Agent, or Firm*—Pro-Techtor International Services

(57) ABSTRACT

A wrench includes a handle with a first jaw and a protrusion respectively extending from an end thereof. A surface is connected between the protrusion and the first jaw. A pivotal member is pivotally connected to the protrusion and has a groove defined in a periphery thereof so as to receive the protrusion and the surface. A second jaw extends from the pivotal member and an end plate ends the groove. A spring biases between the end plate and the surface. The width between the first jaw and the second jaw can be adjusted by pivoting the pivotal member.

2 Claims, 7 Drawing Sheets

OPEN ENDED WRENCH

FIELD OF THE INVENTION

The present invention relates to a wrench that has a pivotal jaw and a fixed jaw. The pivotal jaw is pushed by a spring in the handle so as to easily adjust the width between the two jaws.

BACKGROUND OF THE INVENTION

A conventional open ended wrench is shown in FIG. 1 and generally includes a handle 100 with a head 102 connected to an end of the handle 100. The head 102 has a slot 103 defined therein so as to form two jaws 104, 105. The width between the two jaws 104, 105 is designed to embrace an object to let two of multiple sides of the object respectively contact the two jaws 104, 105. Therefore, when rotating the handle 100, the object is rotated by the two jaws 104, 105. The width between the two jaws 104, 105 cannot be adjusted so that the users have to prepare many wrenches with different sizes. If the head of the object is rounded, the conventional wrench cannot hold the object properly.

The present invention intends to provide a wrench which width between jaws can be adjusted so as to easily embrace different sizes of objects.

SUMMARY OF THE INVENTION

In accordance with one aspect of the present invention, there is provided a wrench comprising a handle with a first jaw and a protrusion respectively extending from an end thereof and a surface is connected between the protrusion and the first jaw. A recess is defined in the surface and a spring has a first end received in the recess. A pivotal member is pivotally connected to the protrusion by a pin and has a groove defined in a periphery thereof so as to receive the protrusion and the surface. A second jaw extends from the pivotal member and an end plate ends the groove. A gap is defined between the end plate and the second jaw. A second end of the spring biases the end plate.

The primary object of the present invention is to provide a wrench wherein one of the jaws of the wrench is pivotally connected to the handle and the width between the two jaws can be easily adjusted.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
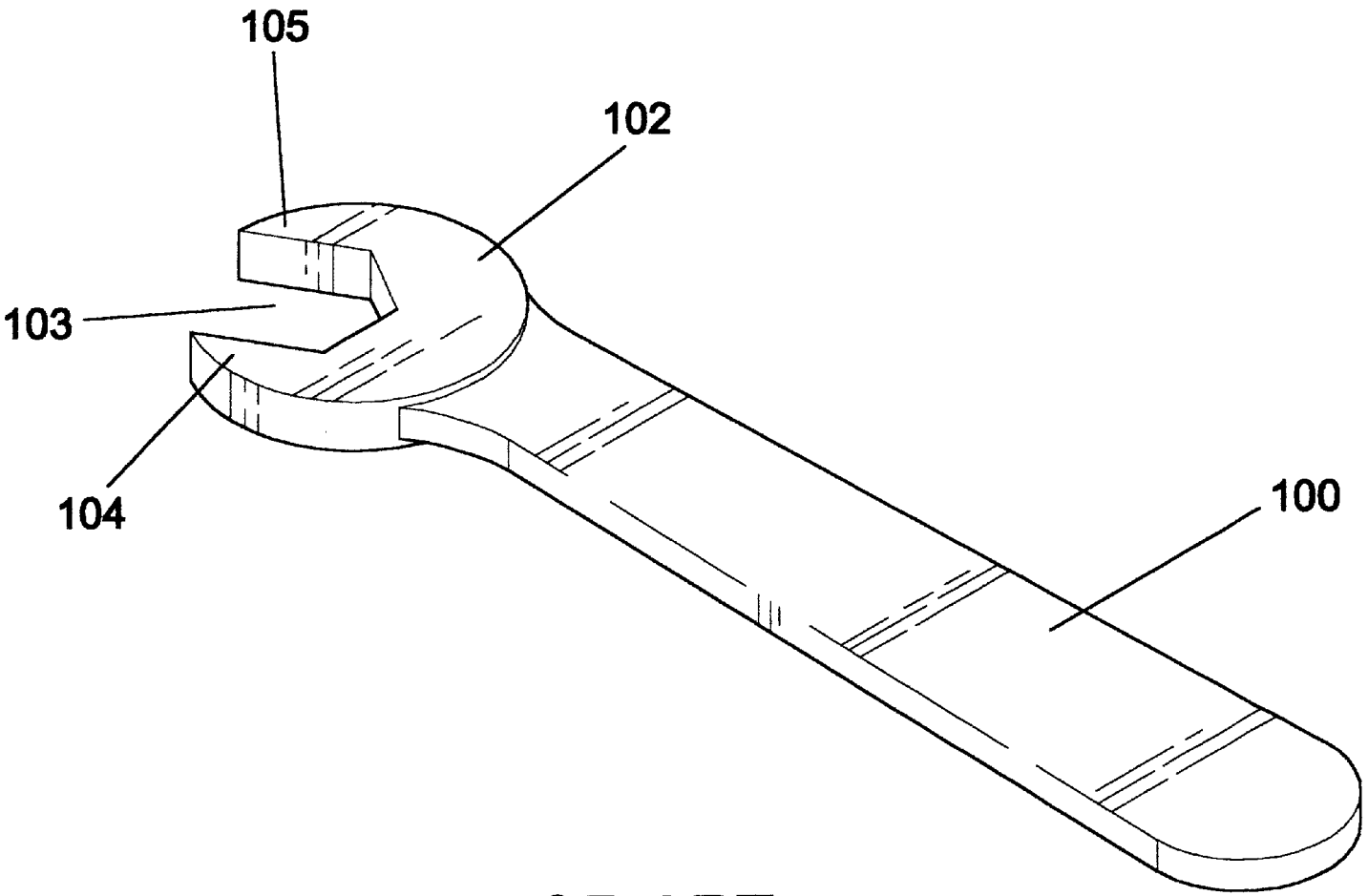
PRIOR ART Fig:1
FIG. 1 is a perspective view to show a conventional wrench.
Figure 2:
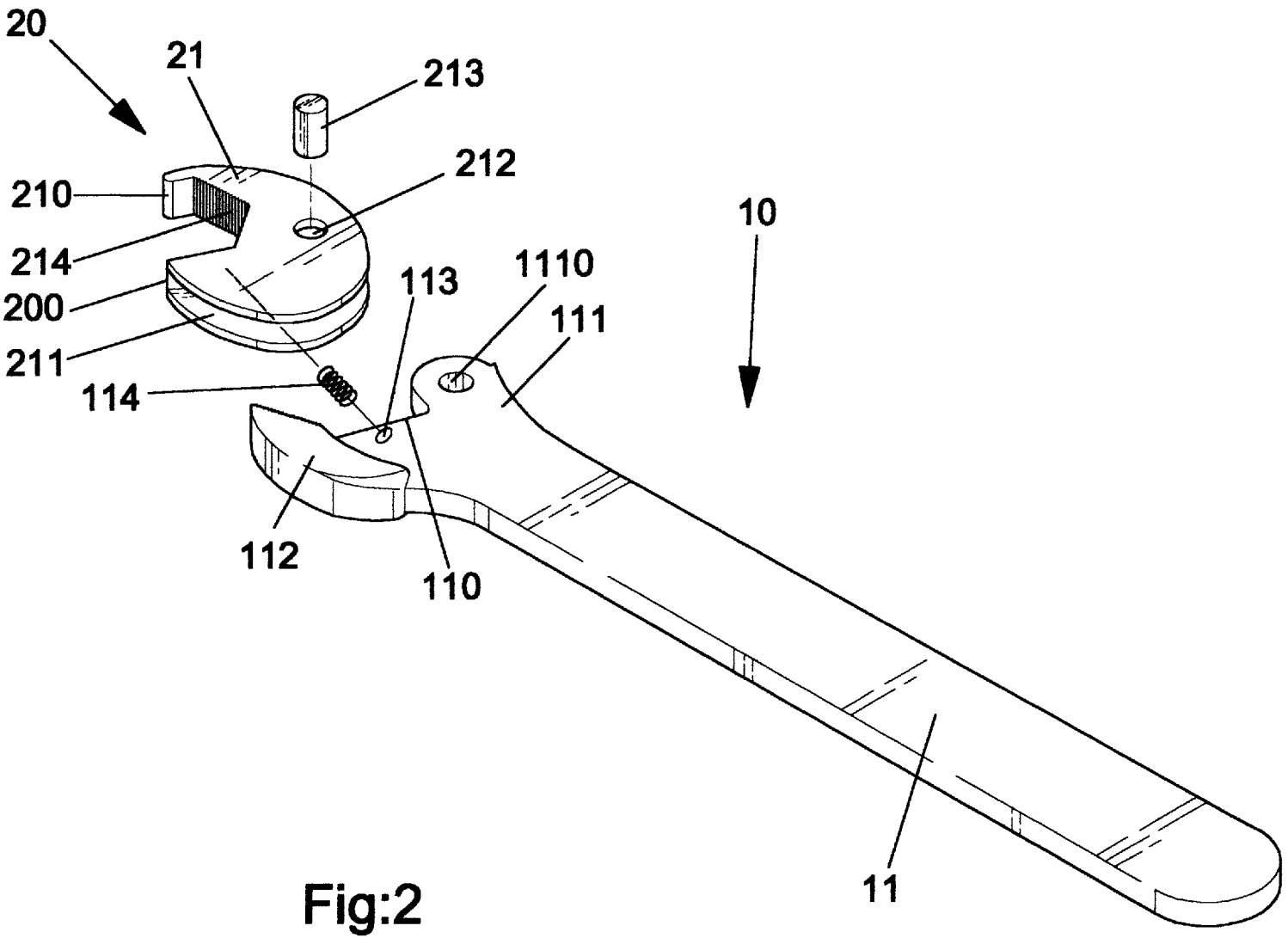
FIG. 2 is an exploded view to show a wrench of the present invention.
Figure 3:
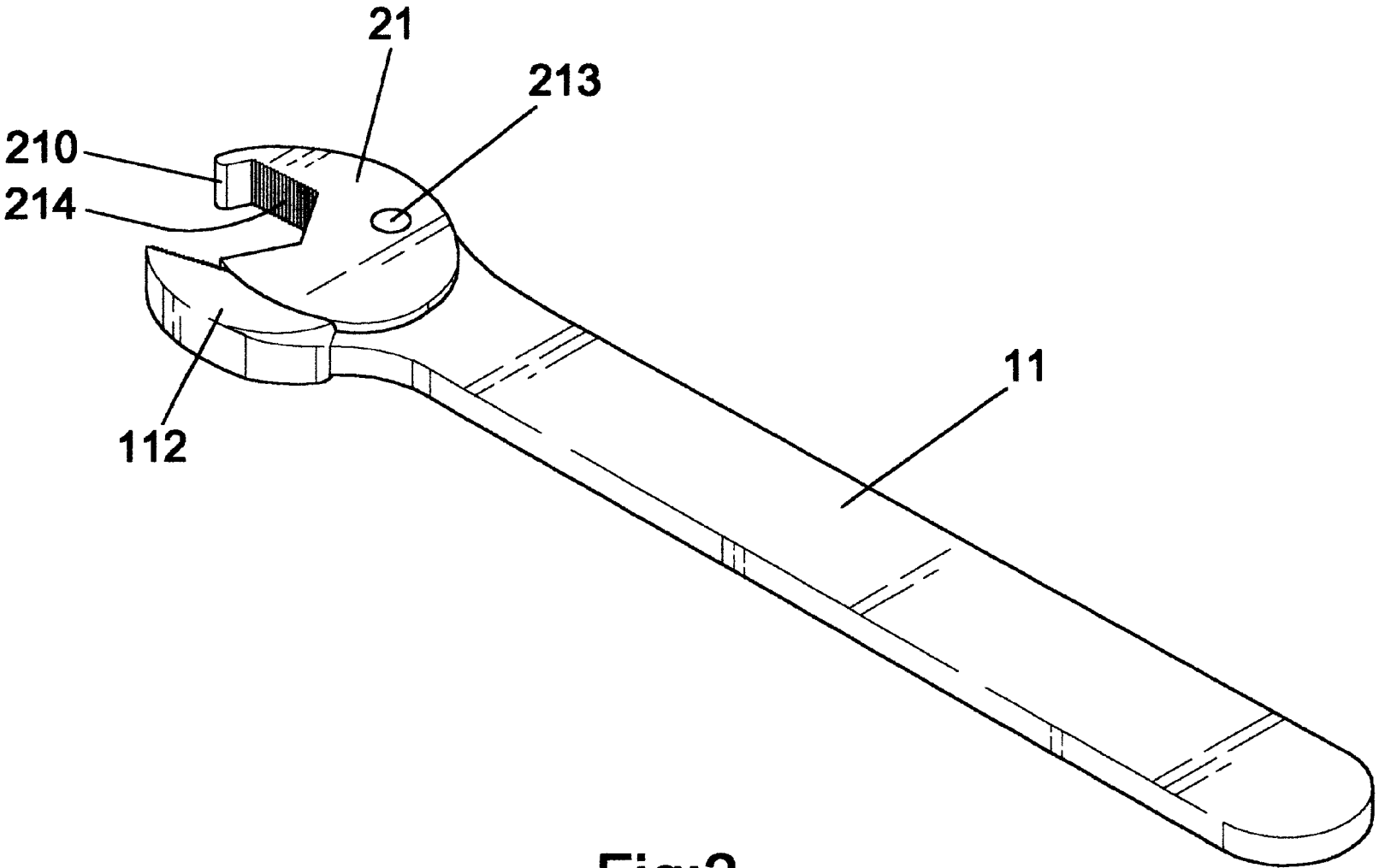
FIG. 3 is a perspective view to show the wrench of the present invention.
Figure 4:
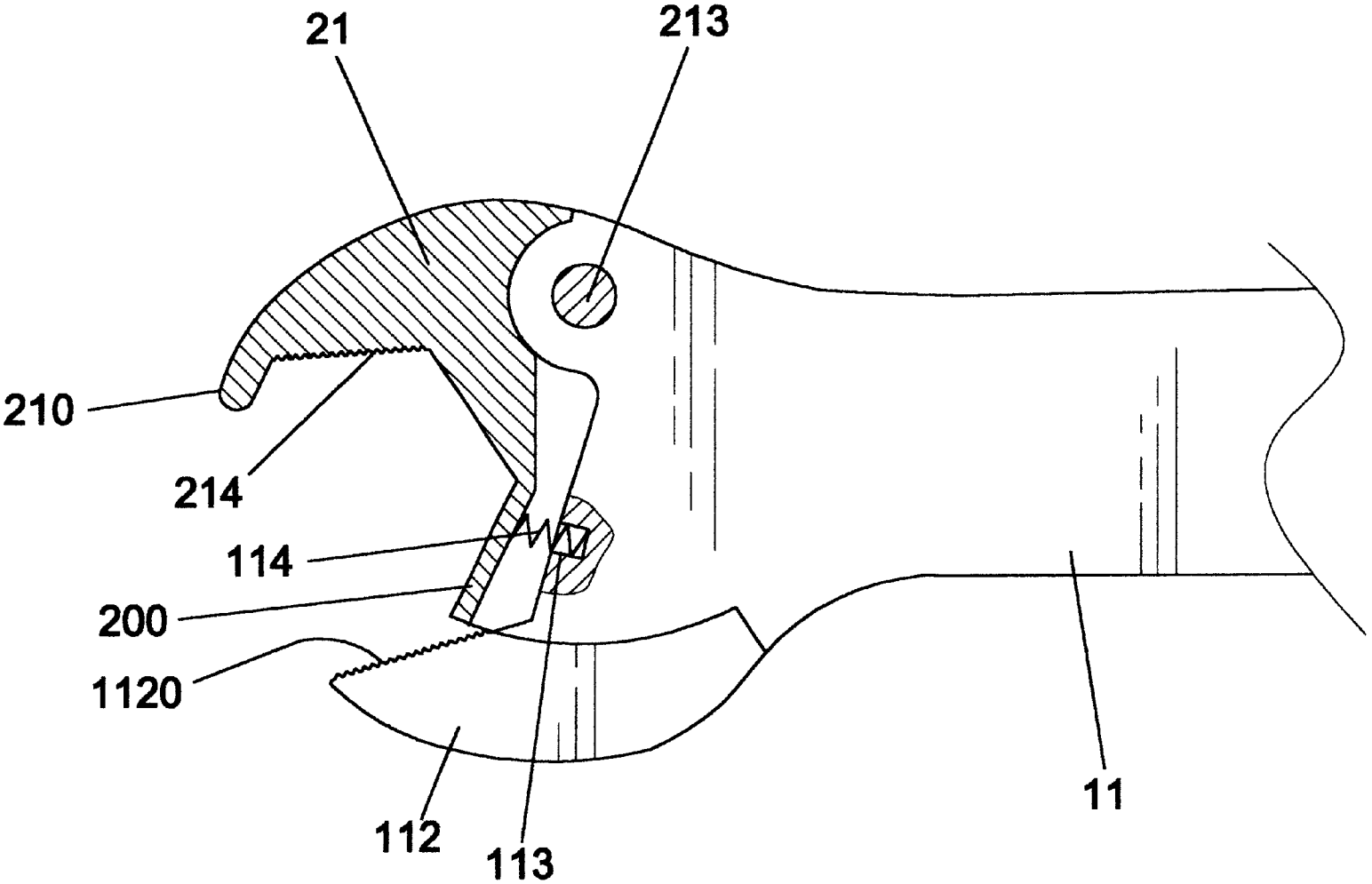
FIG. 4 is a cross sectional view to show the wrench of the present invention.

Referring to FIGS. 2 to 4, the wrench 10 of the present invention comprises a handle 11 with a first jaw 112 and a protrusion 111 respectively extending from an end thereof. A surface 110 is connected between the protrusion 111 and the first jaw 112. A first hole 1110 is defined through the protrusion 111 and a recess 113 is defined in the surface 110. A spring 114 has a first end thereof received in the recess 113.

A pivotal member 20 has a groove 211 defined in a periphery thereof so as to receive the protrusion 111 and the surface 110. A second hole 212 defined through the pivotal member 20 so that a pin 213 extends through the second hole 212 of the pivotal member 20 and the first hole 1110 of the protrusion 111 to pivotally connect the protrusion 111 and the pivotal member 20. A second jaw 21 extends from the pivotal member 20 and an end plate 200 ends the groove 211 so that a second end of the spring 114 biases the end plate 200. A gap is defined between the end plate 200 and the second jaw 21. The first jaw 112 has a toothed surface 1120 and the second jaw 21 has a toothed surface 214 so as to easily grasp an object therebetween. An extension portion 210 extends from the second jaw 21 so as to embrace the object to be clamped between the first jaw 112 and the second jaw 21.

Figure 5:
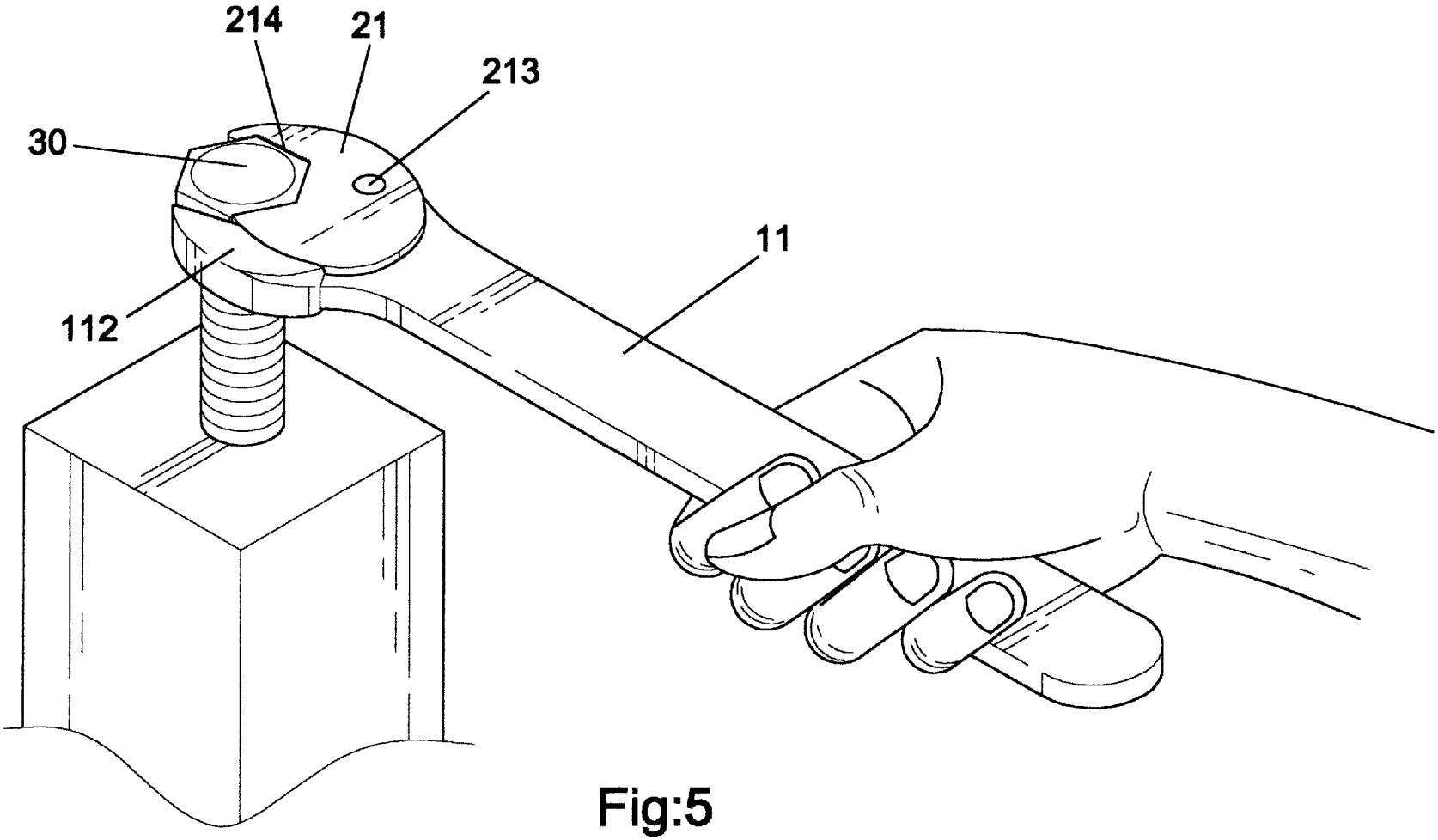
FIG. 5 is a perspective view to show that the wrench of the present invention mounted to an object with one side of the bolt head matched with the second jaw.
Figure 6:
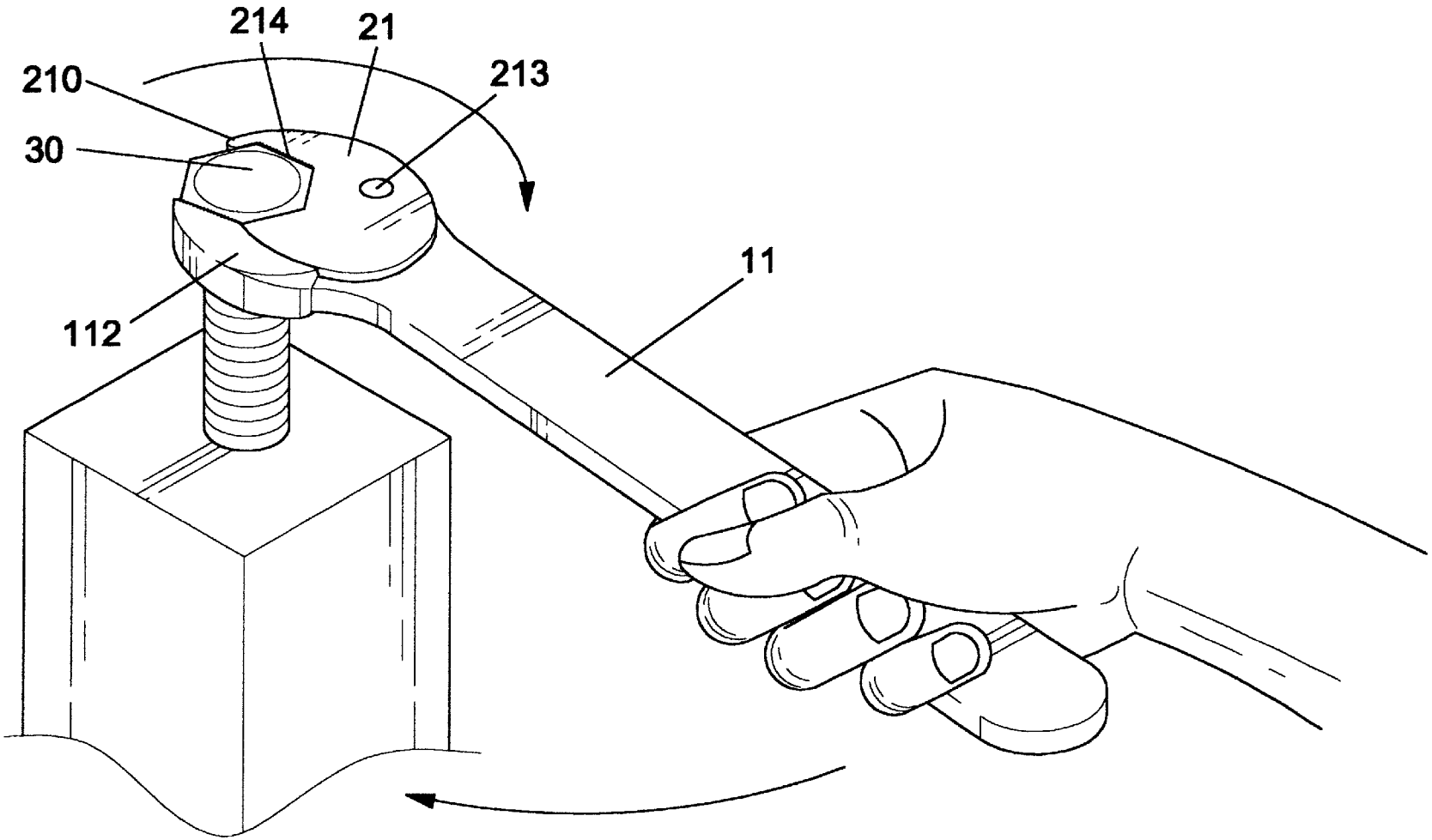
FIG. 6 is a perspective view to show that the wrench of the present invention is rotated to pivot the second jaw to match another side of the object.

As shown in FIG. 5, when mounting the wrench 10 to the object 30, the toothed surface 214 of the second jaw 21 is first matched with one of six sides of the object 30, and a gap between the first jaw 12 and the second jaw 21 is at its largest width because the spring 114 pushes the end plate 200 outward. The handle 11 is then rotated to compress the spring 114 as shown in FIG. 6 to match the toothed surface 1120 of the first jaw 112 with another side of the object 30, and match the end plate 200 with yet another side of the object 30. Therefore, the object 30 is securely clamped by the first jaw 112, the second jaw 21 and the end plate 200. The extension portion 210 embraces an peak of the object 30 so that the wrench 10 will not disengage from the object 30 during rotating.

Figure 7:
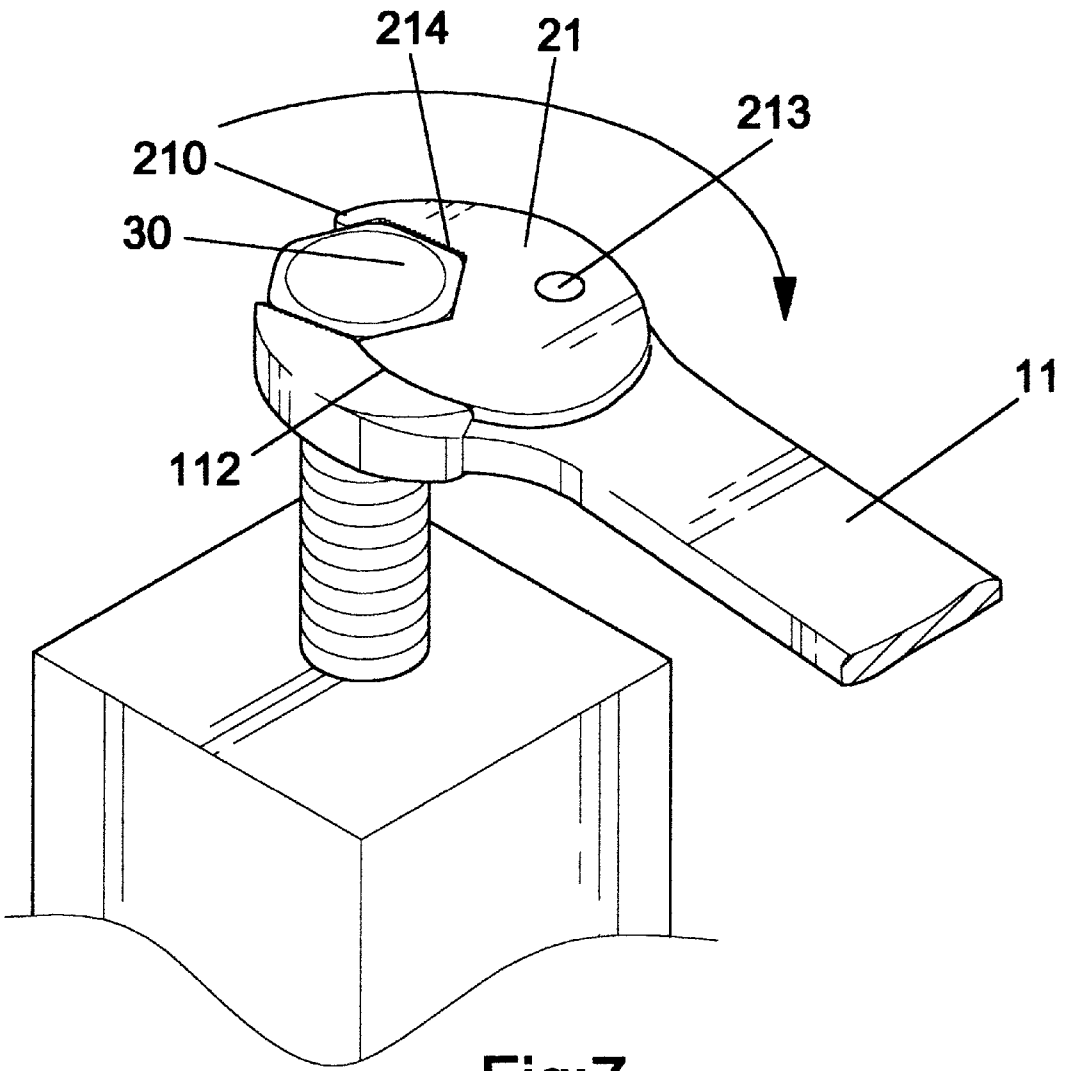
FIG. 7 shows that a rounded object can be clamped by the wrench of the present invention.

As shown in FIG. 7, even if the object 30 is rounded, the width adjustable wrench 10 can also clamp the object 30 securely because when compressing the spring 114, the end plate 200 and the first jaw 112 are moved to match two sides of the object 30.

While we have shown and described the preferred embodiment in accordance with the present invention, it should be clear to those skilled in the art that further embodiments may be made without departing from the scope of the present invention.

What is claimed is:

1. A wrench comprising:

a handle, a first jaw and a protrusion respectively extending from an end of said handle and a surface connected between said protrusion and said first jaw, a recess defined in said surface and a spring having a first end thereof received in said recess, and a pivotal member having a groove defined in a periphery thereof so as to receive said protrusion and said surface, a pin extending through said pivotal member and said protrusion, a second jaw extending from said pivotal member and an end plate ending said groove, a gap defined between said end plate and said second jaw, a second end of said spring biasing said end plate.

2. The wrench as claimed in claim 1 further comprising an extension portion extending from said second jaw.

* * * * *